US005338164A

United States Patent [19]

Sutton et al.

[11] Patent Number: 5,338,164

[45] Date of Patent: Aug. 16, 1994

[54] POSITIVE DISPLACEMENT MICROPUMP

[75] Inventors: Robert F. Sutton, Newbury Park; Ramin Tabibzadeh, Los Angeles; Ko-Wei Lang, West Hills, all of Calif.

[73] Assignee: Rockwell International Corporation, Seal Beach, Calif.

[21] Appl. No.: 68,049

[22] Filed: May 28, 1993

[51] Int. Cl.[5] ..... F04B 17/00

[52] U.S. Cl. ..... 417/413 A

[58] Field of Search ..... 417/413 A, 412, 410, 417/395, 474–479

[56] References Cited

U.S. PATENT DOCUMENTS

| | | | |
|---|---|---|---|
| 2,971,471 | 2/1961 | Huebschman | 417/474 |
| 3,107,630 | 10/1963 | Johnson et al. | 103/152 |
| 3,657,930 | 4/1972 | Jacobson | 74/5 |
| 4,519,751 | 5/1985 | Beckman et al. | 417/322 |
| 4,648,807 | 3/1987 | Tippetts et al. | 417/322 |
| 4,939,405 | 7/1990 | Okuyama et al. | 310/330 |
| 5,246,347 | 9/1993 | Davis | 417/474 |

FOREIGN PATENT DOCUMENTS

| | | | |
|---|---|---|---|
| 1167475 | 7/1989 | Japan | 417/413 A |
| 2238833 | 6/1991 | United Kingdom | 417/413 A |

*Primary Examiner*—Richard A. Bertsch
*Assistant Examiner*—Peter Korytnyk
*Attorney, Agent, or Firm*—H. Fredrick Hamann; Harry B. Field; Steven E. Kahm

[57] ABSTRACT

This invention is for a pump having a series of chambers in a stack wherein electrodeformable material is used to deform a diaphragm to change the volume in the chambers. The architecture of the pump features stacks of chambers having a common diaphragm between adjacent chambers such that when a diaphragm is deformed to increase the volume in one chamber it simultaneously decreases the volume in the adjoining chamber. In one embodiment the stacks of chambers can be combined with other stacks to increase the head pressure in stages. In a second embodiment the stages can be in the same stack.

7 Claims, 4 Drawing Sheets

POSITIVE DISPLACEMENT MICROPUMP

BACKGROUND OF THE INVENTION

1. Field of the Invention

This invention relates to pumps and more specifically to pumps having electrically stimulated electrodeformable diaphragms for pumping fluids.

2. Description of the Related Art

In the past piezoelectrically operated diaphragms have been used in pumps, but the architecture of the pumps have been designed for single chambers to function in a stand alone fashion with either one or two diaphragms per chamber. These pumps were limited in the volume of fluid and head pressure which could be developed.

SUMMARY OF THE INVENTION

The invention discloses how to stack a plurality of chambers having piezoelectric diaphragms so that adjacent cells share a diaphragm. The diaphragms when electrically actuated decrease the volume of one cell and increase the volume of the adjacent cell. The design allows for large volumes and high head rises by a multiplicity of cells acting in parallel and series.

The pump is a compact micropumping device having stacks of electrically stimulated electrodeformable materials on the diaphragms. The diaphragms are contoured as plates or discs. The diaphragms are enclosed in a housing with fluid inlets and outlets and valves for fluid direction flow control.

OBJECTS OF THE INVENTION

It is a primary object of the present invention to provide a compact positive displacement pumping system having the capacity for fluid suction and expulsion, without reversing the preferential flow direction, and to accommodate ganging of the device concept to produce higher flows and/or head rises.

It is another object to provide a micropumping system which entirely eliminates the use of a conventional rotor and rotor bearings.

Other objects, advantages and novel features of the present invention will become apparent from the following detailed description of the invention when considered in conjunction with the accompanying drawings.

DETAILED DESCRIPTION OF THE PREFERRED EMBODIMENT

Figure 1:
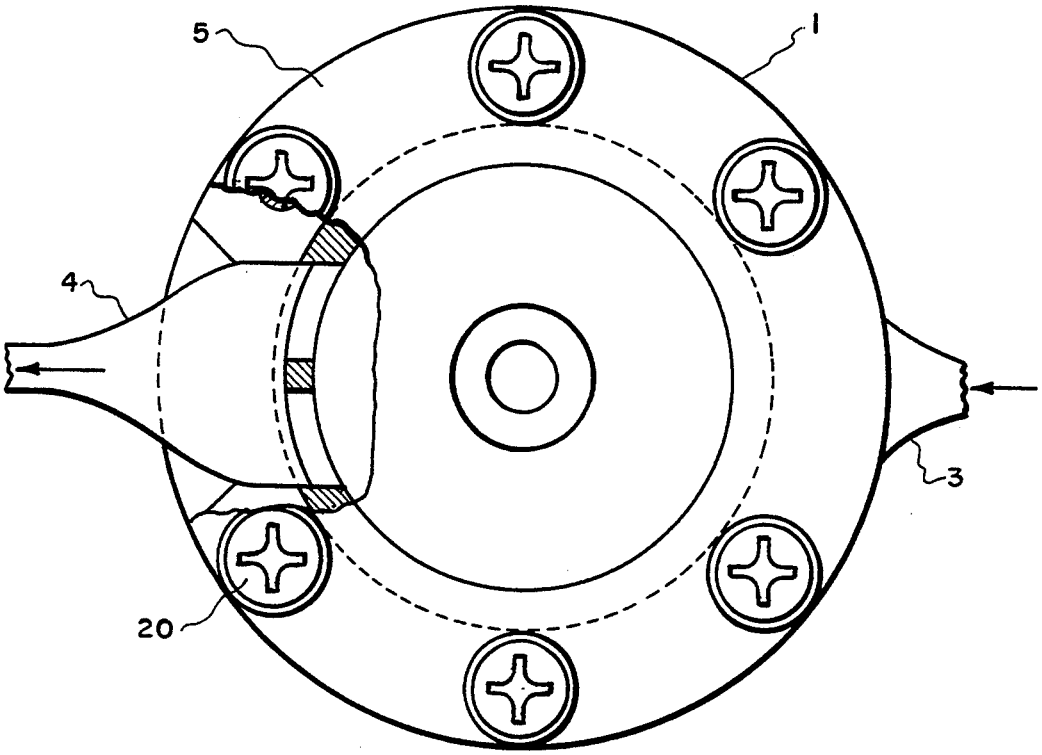
FIG. 1 is a top view of the pump showing the inlet and discharge ports for one chamber.
Figure 2:
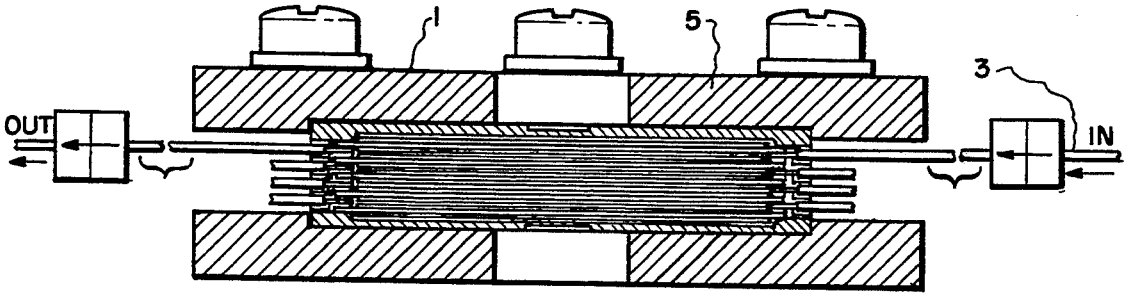
FIG. 2 is a cross-section view of the pump showing the inlet and discharge ports for one chamber in a stack of chambers.
Figure 3:
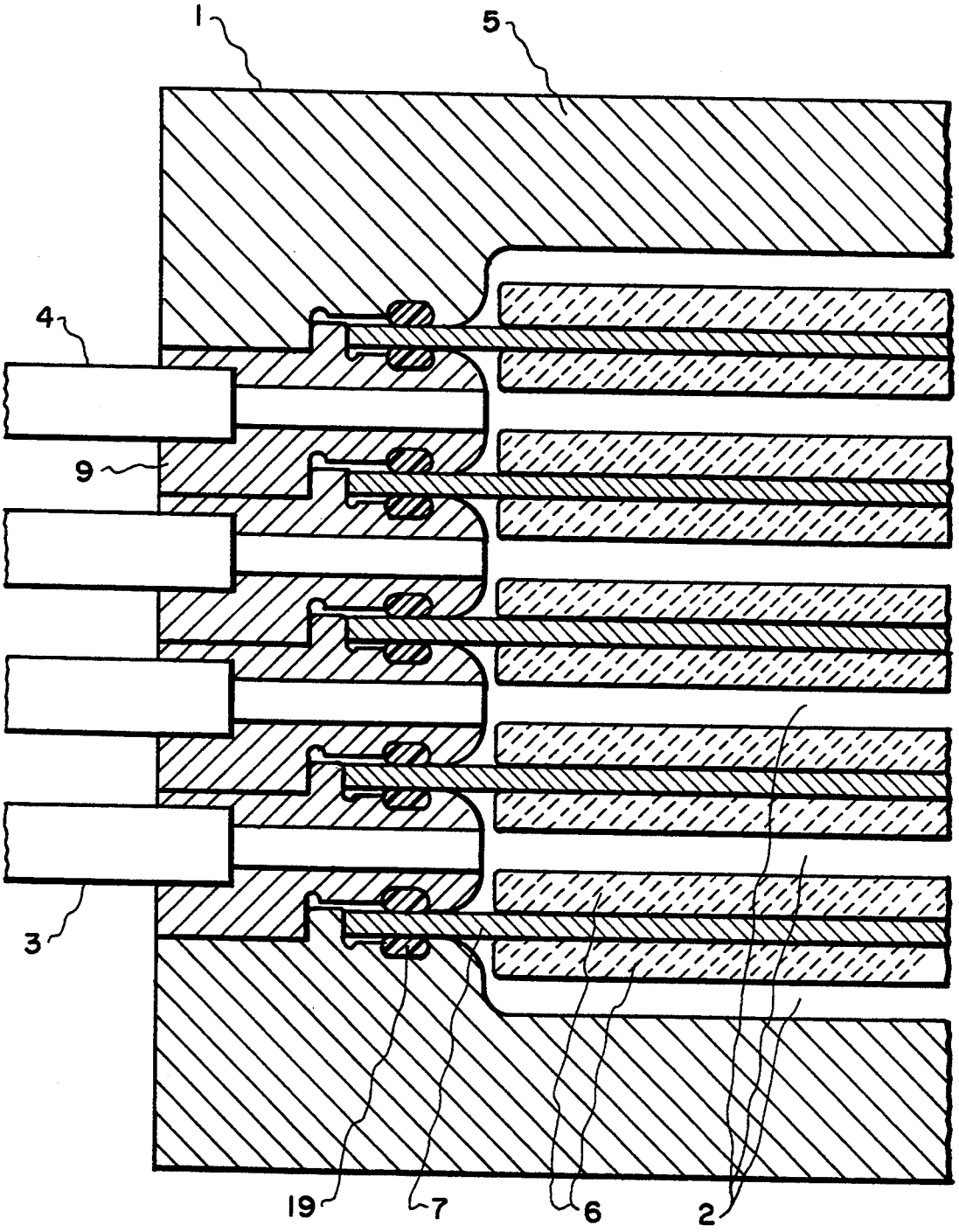
FIG. 3 is a close-up cross-section view of a portion of a four chamber stack in the pump housing.
Figure 4:
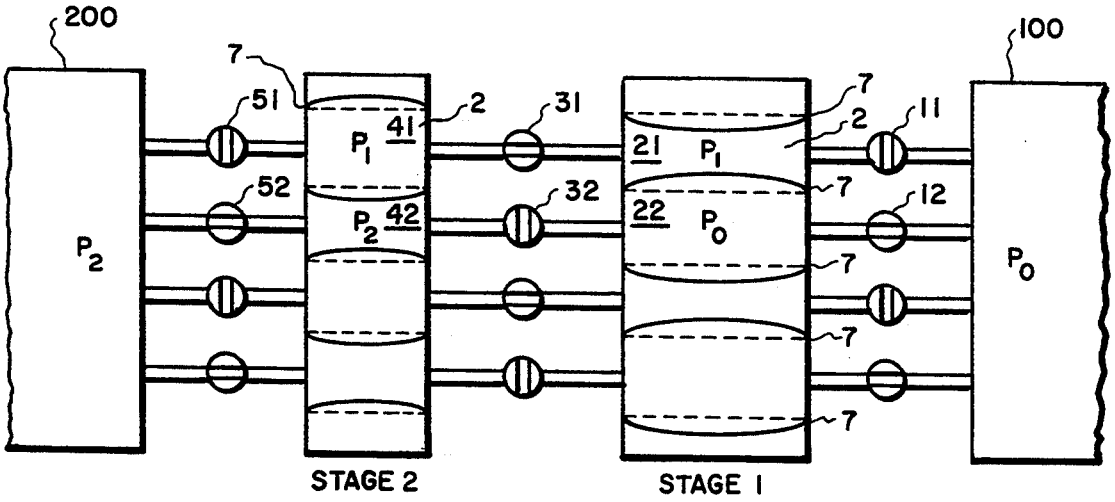
FIG. 4 is a schematic of the operation of a horizontal series of chambers in a two stack pump.

FIG. 1 shows a top view of the pump 1. In this embodiment the diaphragms in the pump are discs so the pump is cylindrically shaped with a circular top. As seen in FIGS. 2 and 3 the pump is comprised of a plurality of chambers 2, separated by discs which act as diaphragms 7. Each chamber has a fluid inlet 3, and a fluid outlet 4. FIG. 3 shows a detailed view of a portion of the pump 1. It shows the chambers 2 separated by diaphragms 7. The diaphragms are electrical conductors for conducting electricity to electrodeformable material such as a piezoelectric material 6 which is placed on the diaphragms to deform them when a charge is applied to the electrodeformable material. When deformed, the diaphragms change the volume of the chamber 2 and thereby pump a fluid. As shown in FIG. 4 when the top chamber diaphragm is deformed downward and the bottom diaphragm is deformed upward the chamber size is decreased and the fluid therein is compressed such as in compressed chamber 21. When chamber 21 is in the compressed mode the adjoining chamber 22 having a common diaphragm with chamber 21 has a top diaphragm which is deformed upward and a bottom diaphragm which is deformed downward thereby expanding the volume of chamber 22. The deformations shown in FIG. 4 are greatly exaggerated in size for clarity. A metallic disc diaphragm two inches in diameter and about 0.008 inches thick can be used with a piezoelectric material bonded to its surface, the deflection at the center of the disc would be about 0.005 inches displacing 0.006 cubic inches per cycle.

As depicted in FIG. 4 the chamber sizes can be reduced in each stage of the pumping process to reduce the volume of the chambers as the pressure increases. The difference in size of the stage 1 chambers and the stage 2 chambers are greatly exaggerated for clarity.

The steps in a pumping cycle are shown in FIG. 4 where a fluid at pressure $P_o$ at source 100 is introduced to the pump at chamber 22. When expanded chamber 22 is at its maximum extension, valve 12 admits fluid at pressure $P_o$ to the chamber. Valve 12 is then closed. The electrodeformable material is actuated to deform the diaphragm from the expanded cell position such as at 22 to the compressed chamber position as at 21. The fluid in the chamber increases from pressure $P_o$ to pressure $P_1$. Valve 31 is open when chamber 21 is at its minimum volume and the fluid flows into the next chamber 41 when it is at its maximum volume. Valve 31 then closes and the fluid is compressed from pressure $P_1$ to pressure $P_2$ as in chamber 42. Valve 52 is then opened and the fluid is admitted to container 200 at pressure $P_2$.

FIG. 3 shows the structure of the chambers. The pump casing contains spacers g which can vary in height to vary the volume of the chambers by displacing the diaphragms. The spacers act as seals preventing the fluid in the chambers from escaping and form passages for the inlets 3 and outlets 4. Insulating material 19 is attached to the spacers to support the diaphragms 7. There is a means of supplying electrical power to the diaphragms which is not shown. This can be done by attaching wires to the diaphragms which run through the spacers 9.

Figure 7:
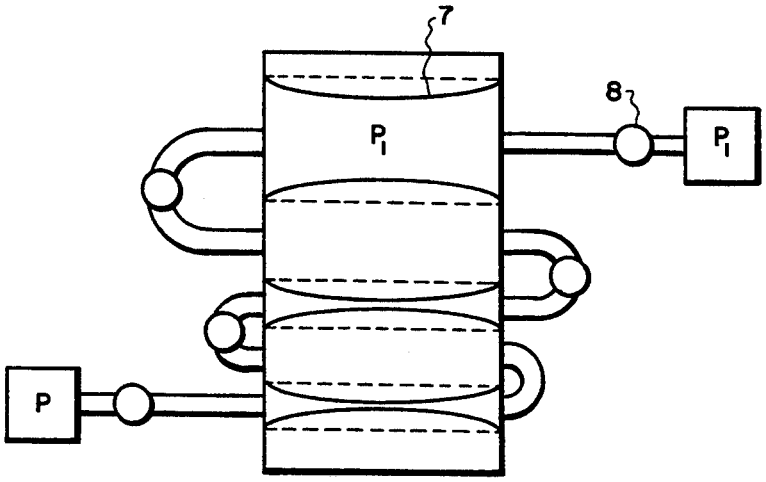
FIG. 7 is a schematic of the operation of a one stack verticle pump.
Figure 5:
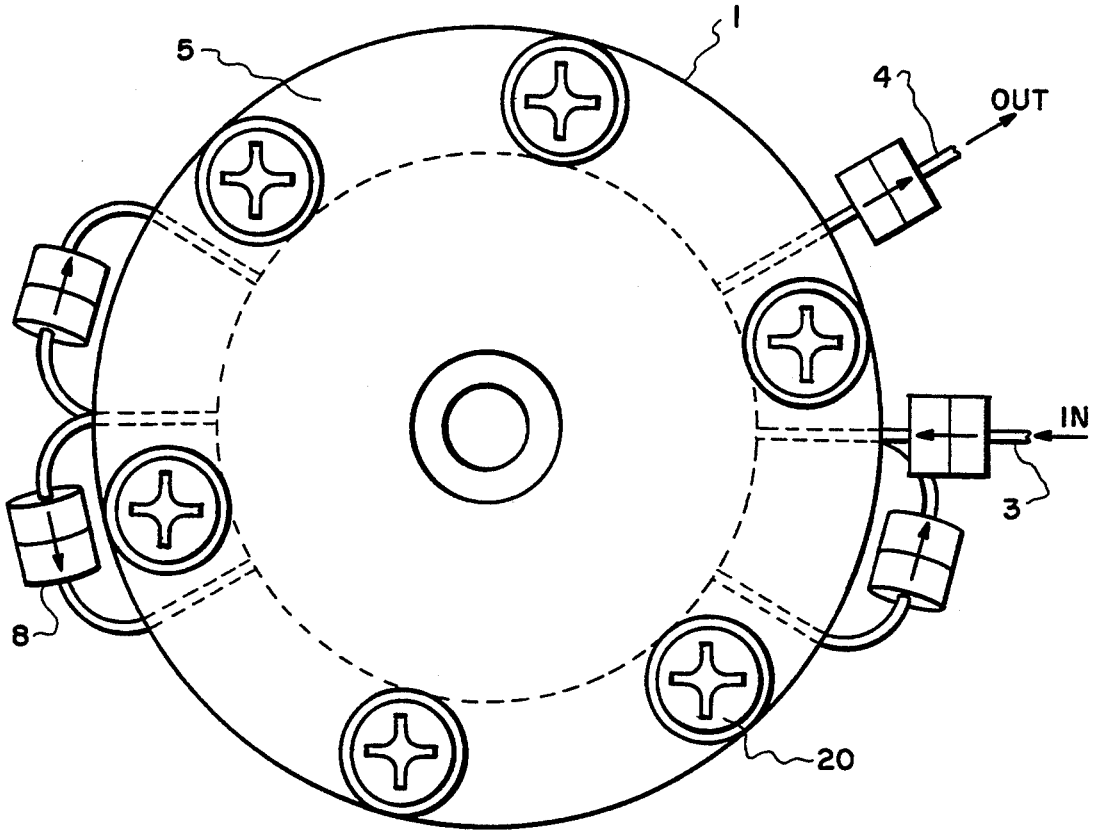
FIG. 5 is a top view of the pump showing the inlet and discharge ports for a stack having a vertical series of chambers.
Figure 6:
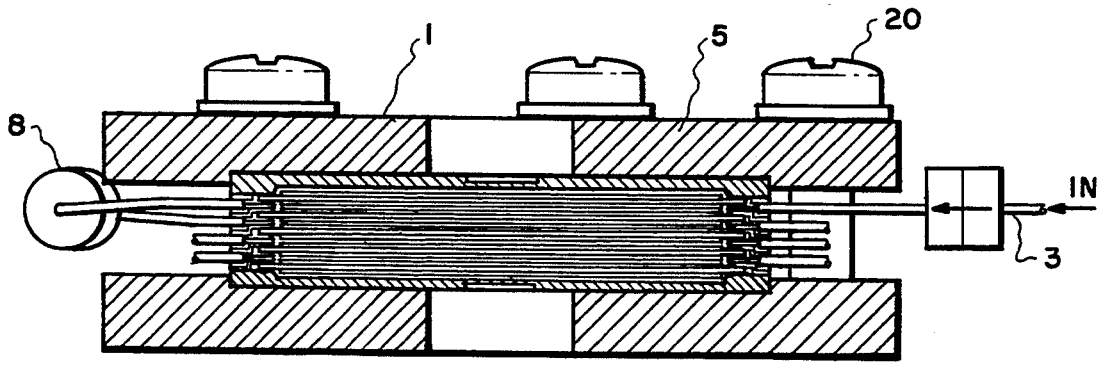
FIG. 6 is a cross-section view of the pump showing the inlet and discharge ports for a stack having a verticle series of chambers.

In the first embodiment shown in FIGS. 1, 2 and 4 the pumps stages are ganged, with each stage in a different stack. In this embodiment the size of the chambers varies in diameter. In a second embodiment the stages are in one stack as shown in FIGS. 5, 6 and 7. The chambers are of decreasing volume in each stage because the spacers between the discs differ in thickness. The valves 8 allow fluid flow only in one direction. Bolts 20 secure the housing containing the diaphragms.

Variations of the operating parameters include having the first stage chamber 21 at a minimum while the second stage chamber 41 is at a rest position as shown by the dotted lines, as in FIG. 4.

Other variations have to do with the rates at which the various stages operated. Such as stage 1 going through 2 cycles for every 1 cycle of stage 2. The timing of the valves may be varied for maximum system efficiency.

In other embodiments intermediate pressure holding tanks may be used between stages.

A controller is used to control the timing and amount of electricity to the diaphragms for proper operation of the chambers. The controller can also operate the valves. The controller may have pressure, valve position and diaphragm position data sent to it from sensors in the pump for efficient operation of the pump.

In another embodiment the top and bottom chambers in a stack may have only one diaphragm, since the housing can be the upper and lower walls of the chamber.

Obviously, many modifications and variations of the present invention are possible in light of the above teachings. It is therefore to be understood that, within the scope of the appended claims, the invention may be practiced otherwise than as specifically described.

What is claimed and desired to be secured by Letters Patent of the United States is:

1. A pump comprising, a plurality of chambers each having a top disc diaphragm, a bottom disc diaphragm and a side wall, an inlet and an outlet for fluid flow to and from each chamber, passing through the side wall, a valve attached to the inlet and a valve connected to the outlet to control the direction of fluid flow, the plurality of chambers stacked such that the disc top diaphragm of one chamber is also the bottom disc diaphragm of the adjacent chamber, each disc diaphragm having an electrodeformable material for deforming the disc diaphragm and changing the volume of the chamber when activated, a means of activating the electrodeformable material so that the top and bottom disc diaphragms in each chamber move toward each other or away from each other simultaneously, the outlet of one chamber is connected to the inlet of another chamber for increasing the pressure of the fluid in stages.

2. A pump as in claim 1 wherein, the outlet of one chamber is connected to the inlet of another chamber in the same stack for increasing the pressure of a fluid in stages.

3. A pump as in claim 1 wherein, the outlet of one chamber is connected to the inlet of another chamber in a different stack for increasing the pressure of a fluid in stages.

4. A pump as in claim 2 wherein, the chamber size varies corresponding to the chamber stage in the pump.

5. A pump as in claim 3 wherein, the chamber size varies corresponding to the chamber stage in the pump.

6. A pump as in claim 1 wherein the top chamber is bounded by the top of the housing and a disc diaphragm and the bottom chamber is bounded by the bottom of the housing and a disc diaphragm.

7. A pump as in claim 1 wherein the top chamber has an inlet and outlet through the top of the housing and the bottom chamber has an inlet and outlet through the bottom of the housing.

* * * * *